United States Patent [19]

Steffero, Sr.

[11] Patent Number: 4,590,688

[45] Date of Patent: May 27, 1986

[54] STEAM DRYER DRUM

[76] Inventor: Robert F. Steffero, Sr., P.O. Box 429, Seymour, Conn. 06483

[21] Appl. No.: 539,549

[22] Filed: Oct. 6, 1983

[51] Int. Cl.[4] ..... F26B 11/00

[52] U.S. Cl. ..... 34/124; 34/119; 285/135

[58] Field of Search ..... 34/119, 124, 125, 121; 285/135, 261, 269

[56] References Cited

U.S. PATENT DOCUMENTS

| | | | |
|---|---|---|---|
| 1,953,525 | 4/1934 | Young | 34/125 |
| 2,164,445 | 7/1939 | Bridge | 285/135 |
| 2,297,094 | 9/1942 | Armstrong et al. | 34/124 |
| 2,366,541 | 1/1945 | Malkin | 285/135 |
| 2,497,183 | 2/1950 | Monroe | 285/269 |
| 2,934,831 | 5/1960 | Tasker | 34/125 |
| 2,978,815 | 4/1961 | Hieronymus | 34/125 |
| 3,473,237 | 10/1969 | McCourt | 34/125 |
| 3,948,283 | 4/1976 | Asfura et al. | 34/125 |

FOREIGN PATENT DOCUMENTS

| | | | |
|---|---|---|---|
| 8002187 | 10/1980 | PCT Int'l Appl. | 34/125 |
| 950720 | 2/1964 | United Kingdom | 34/125 |

*Primary Examiner*—Albert J. Makay
*Assistant Examiner*—Steven E. Warner
*Attorney, Agent, or Firm*—Thomas J. Greer, Jr.

[57] ABSTRACT

A steam heated dryer of the hollow rotary drum type employed to dry paper webs of indefinite length. The steam condensate (water) is continuously removed from the lower interior portion of the drum by a siphon-like tube, the horizontal part of the condensate removal tube is stationary with respect to the rotating drum and its separate, angled input end spaced from the drum interior wall. The input end executes limited angular motion, so as to follow the mass of the condensate which rises slightly up the sides of the drum upon drum rotation. A bellows expansion joint is carried by the condensate removal tube. The condensate removal tube is supported by one or more spider supports, the spider supports formed of a heat resistant elastomer or resin, the spider support carrying a self-lubricating bearing ring which receives the condensate tube. Damage due to vibration is reduced. The pressure differential between the steam entering the drying drum and that in the condensate return tube is such that the condensate return tube is always filled with condensate, thus inhibiting flashing of the liquid condensate in the tube back into steam. Non-condensable gases are removed from the drum interior by an eductor effect produced in a portion of the condensate return line.

2 Claims, 6 Drawing Figures

STEAM DRYER DRUM

This invention relates to a steam heated rotary dryer construction, the dryer being intended to heat webs of indefinite lengths. The specific use of the invention resides in the art of paper manufacturing wherein paper webs of indefinite length, still moist, require drying. In the papermaking art, it is customary to effect drying of paper webs by placing them in contact with the external surfaces of rotary drums rotating about their longitudinal axes, the drum interiors being heated by steam. Heat from the steam is transferred to the interior of the drum and is, in turn, transferred to the metal walls of the drum wherein the final heat transfer from the metal walls of the drum to the paper web occurs.

Steam is fed or led into the interior of each rotating drum dryer by means of a hollow journal, the steam passing through the hollow journal and into the interior of the drum. As the steam loses its heat energy it changes to the liquid phase, forming a pool of liquid condensate at the bottom of each drum. The art has long recognized the need for constant removal of this condensate and non-condensible gases as the drum rotates and as the paper web is dried.

A variety of condensate removal apparatus has evolved in the art, this apparatus including either a stationary condensate return tube or a rotating condensate return tube. The condensate return tube is often referred to in this art as a siphon or a siphon tube. In the rotary type of siphon or condensate return tube, the tube extends into the drying drum interior, coaxially with a steam inlet journal (in turn coaxial with the axis of rotation of the steam drum) with the entrance or interior portion of the condensate tube being bent so that its tip is adjacent to or contiguous with the rotating interior surface of the steam drum. The condensate return tube rotates with the steam drum, so that the entrance end of the condensate return tube is always at the same angular position relative to the rotating steam drum.

In the stationary type of condensate return tube, the construction is generally the same, except that the condensate return tube is stationary with respect to the rotating drum.

Both types of condensate return tubes have enjoyed success in this art. U.S. Pat. No. 3,265,411 issued to Monroe et al illustrates these two types of condensate return tubes.

One problem encountered in a typical steam dryer drum system is that due to harmonic vibration. Most of the elements of such prior dryer drum and piping constructions have been formed of rigid metal. With continued stresses induced by harmonic vibrations, serious problems with misalignment and breakage have in the past often occurred. Another problem is that due to thermal expansion and contraction of the elements of such an installation. Prior to start-up, the temperature of the entire installation is essentially that of ambient, while during operation the temperature of some parts of the system is that of the steam and the differential can accordingly be as much as 309° F. Thus, strains due to relative expansion of elements of the system can cause severe problems.

According to the practice of this invention, these problems are significantly reduced by the use of non-metallic elements in combination with elements which are purposefully expansible and contractable.

Another advantage over the prior art exhibited by the practice of this invention is the more rapid transfer of heat energy from the steam to the interior of the steam drums. This is carried out by constricting the steam inlet path at its exit into the drum, so as to increase the velocity of the steam just prior to its entrance to the interior of the steam drum. Actual field testing has shown that this increased velocity of the steam results in a more rapid transfer of heat energy carried by the steam from the steam inlet hollow journal to the interior of the steam drum.

Another advantage over typical prior art constructions structions enjoyed by the practice of this invention is the use of a stationary siphon which is firmly and accurately supported within the usual hollow steam inlet journal, so that the siphon entrance tip or end is accurately positioned relative to the drum interior surface. Typical prior art constructions employing stationary condensate return tubes which do not employ this feature are afforded by U.S. Pat. Nos. 693,652 issued to Keller, 1,489,277 issued to Rains, 2,366,541 issued to Malkin, 2,502,365 issued to Bard, and the above-noted patent to Monroe.

Another advantage enjoyed by the practice of this invention is the substantial elimination of the problem of flashing of the condensate within the return tube. The term flash as used in this art refers to the changing of phase of the withdrawn liquid condensate, from the interior of the steam drums, back into steam. This can occur when the relatively cooler condensate receives the heat energy from the steam entering the hollow journal for eventual passage into the interior of the steam drums, this heat transfer naturally arising from the placement of the condensate return tube coaxially with the hollow journal steam input duct. To avoid flashing according to the practice of this invention, the siphon tube itself usually is full of liquid, rather than a gas and liquid combination. This liquid is led or fed into a steam trap externally mounted from the rotary union. When the liquid from the interior of the roll and siphon fill the steam trap, the weight of the liquid causes it to open. When the steam trap opens a substantial pressure differential exists momentarily, allowing the liquid to flow in great volume through the siphon tube so as to keep the tube flooded. Thus, flash steam or a change of phase is avoided inside the siphon tube itself. The system is so operated that the liquid condensate return tube is always filled with condensate and under sufficient pressure so as to inhibit or prevent flashing.

Further, according to the practice of this invention, a ball joint between the angle portion and the horizontal portion of the condensate return tube is provided with a bore or passageway to thereby enable the joint to suck in non-condensable gases which are often present in the interior of steam dryer drums. Such gases if allowed to accumulate within the drums will cool their surfaces. The condensate liquid, passing through the return line and hence through this joint, acts to produce an eductor effect, thus sucking in any non-condensable gases in the region of the joint, i.e., in the region centrally of the drum. Air changes its specific gravity when heated. Therefore, it is not exactly known where the accumulation of air will be entrained. It is thought to be more in the center than the top.

IN THE DRAWINGS

Figure 1:
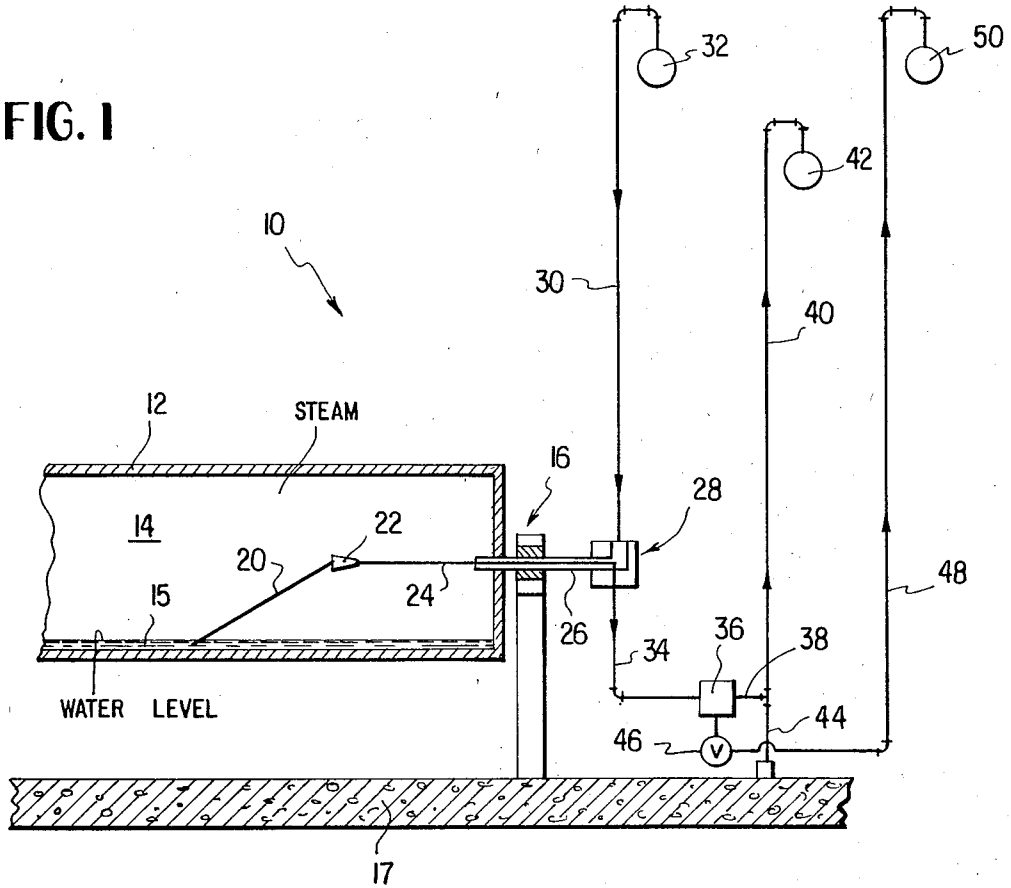
FIG. 1 is a partially schematic view of a steam dryer drum system according to the practice of this invention.
Figure 2:
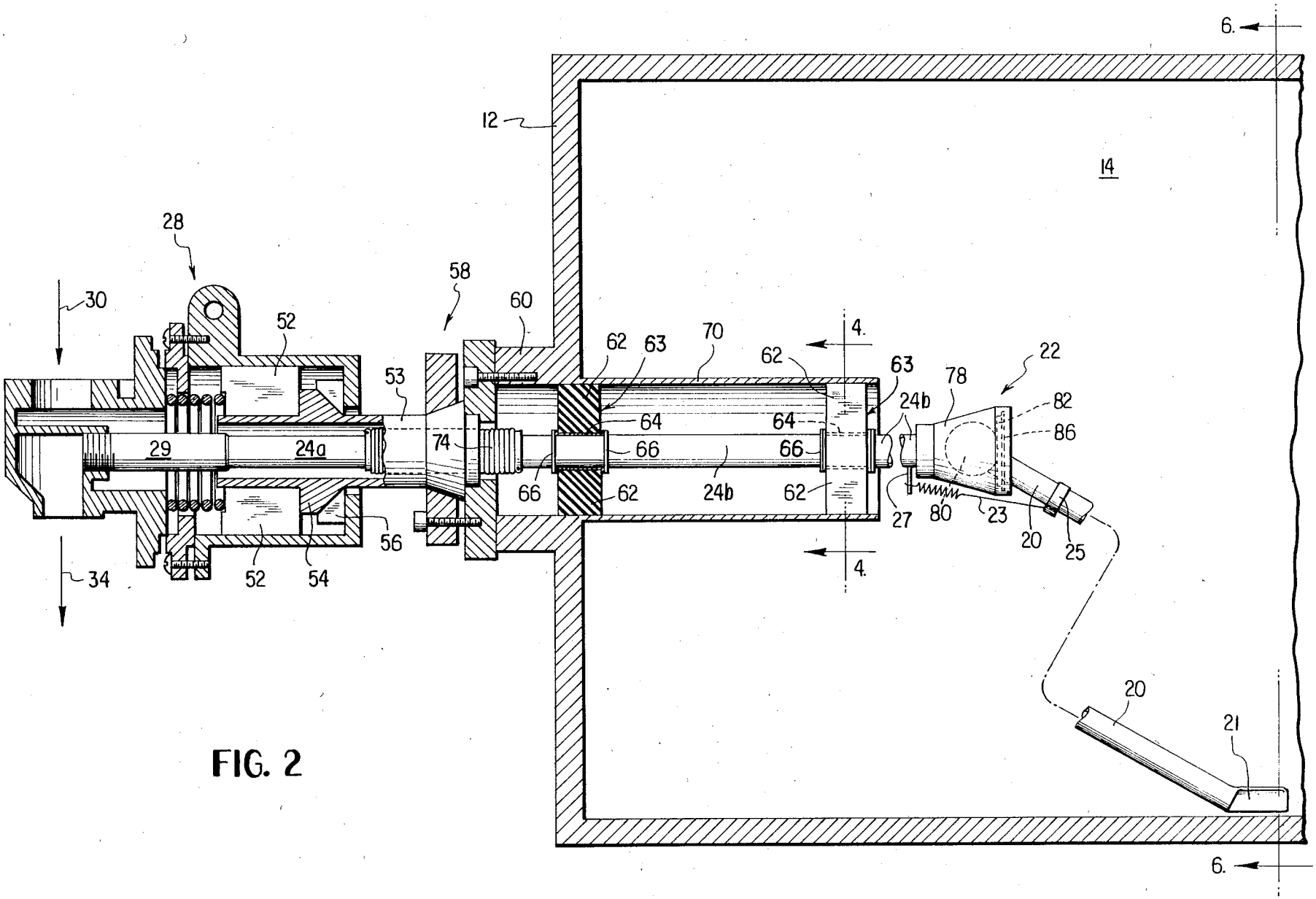
FIG. 2 is a cross-sectional view of a portion of a typical steam dryer drum, according to this invention, showing its connections with the incoming steam line and the outgoing liquid condensate line.

Referring now to FIGS. 1 and 2 of the drawings, the numeral 10 denotes a portion of a steam dryer drum system, FIG. 1 showing one typical steam dryer in a bank of such dryers. The numeral 12 denotes a typical rotary drum dryer whose hollow interior 14 is filled with steam, some of the steam having condensed to liquid at the bottom of the drum and denoted by the numeral 15. The numeral 16 denotes schematically a bearing and mount for one end of the drum, it being understood that a similar bearing and mount is at the other, not illustrated, end of drum 12. The numeral 20 denotes the intake portion or end of a liquid condensate return tube, sometimes referred to in the art as a siphon tube, portion 20 being essentially straight and angled to the horizontal and including a joint schematically denoted by the numeral 22. A tension coil spring 23 is secured at one end to the right portion 24*b* of a horizontally disposed condensate return line 24 by a spring retainer 27, the other end of the spring is secured to tube 20 by a stainless steel slip ring 25. The radially outermost portion of angled tube 20, relative to drum 12, is provided with an integral vane or paddle 21, tube 20 and paddle 21 being fashioned typically of Teflon or other rigid and heat resistant plastic. The right horizontal portion 24*b* of the condensate return line passes concentrically through hollow journal 26 into a steam union or housing 28. Housing 28 is coupled by hydraulic line 30 to steam header 32, the latter being coupled to a steam generator. Condensate return tube 26 (FIG. 1) is also coupled in housing 28 to line 34, the latter leading into a steam trap 36, one output 38 of which feeds into condensate return line 40, in turn coupled to a condensate densate sump tube 42. Line 44 is also coupled to line 38. The other output of steam trap 36 leads to a metering valve 46, in turn coupled to a secondary steam line 48, also termed a flash steam line, leading to a flash steam header 50. The hydraulic circuitry defined by elements 34 to 50 is known in this art, see for example, U.S. Pat. No. 1,916,073 issued to Rosenblad.

Figure 6:
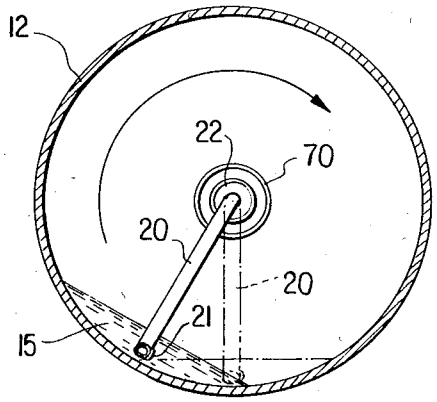
FIG. 6 is a view taken along section 6—6 of FIG. 2.

During operation, steam dryer drum 12 rotates about its longitudinal axis, with the input end or tip of liquid condensate return line 20 being in contact with the interior surface of drum 12. The condensate return line defined by angled portions 20, left horizontal tube portion 24*a* and right horizontal portion 24*b* does not rotate with rotation of the drum. The angled portion 20 does, however, rotate slightly so as to follow the angular position of the body or mass of condensate which accumulates at the lower portion of the drum. With drum rotation, as shown at FIG. 6, this condensate mass will rise somewhat up the side of the drum interior. The vane 21 compels the input end of angled tube 20 to remain more or less in the deepest portion of the condensate mass. The steam pressure in line 30 may typically be 175 psi, while the steam pressure within drum 12 may typically be 173 psi. The pressure within condensate return line 40 may typically be in the range of 25–40 psi. Drum 12 is conventionally rotated, with an indefinite length web of paper, not illustrated, passing around at least a portion of its periphery for transferring heat from the drum to the paper to dry the paper web. Each end of drum 12 may be provided with a support 60, in turn rotatably supported by conventional bearing structures, not shown. Support bearing 60 usually undergoes offaxis motion, in the nature of processional motion, due to out of round drum drying surfaces, and other causes. The rate of steam input to the drum 12 is so regulated that, with the other conditions of operation, portion 20 of the condensate return line is always filled with the liquid condensate (water) from pool 15. The pressure differential between the inside of the chamber and line 40 maintains the condensate in liquid form and inhibits or precludes flashing.

Referring now to FIG. 2 of the drawings, a detailed view of certain of the elements of the system of FIG. 1 is given. Housing 28 includes split brass wedges 52 surrounding a portion of rotatable hollow shaft 53, the latter including integral flanges 54. Rim 56 abuts enlargements 54, as illustrated. Steam input line 30 and condensate exit line 34, as schematically indicated, are secured to housing 28 at the left portion of FIG. 2. The details of construction of housing 28 are known in this art, and may be seen, for example, at FIG. 1 of the Monroe patent previously noted.

The numeral 58 denotes generally a steam seal at the exterior portion of bearing or journal section 60 of steam dryer 12.

Figure 4:
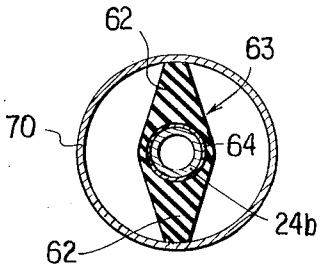
FIG. 4 is a view taken along section 4—4 of FIG. 2.
Figure 3:
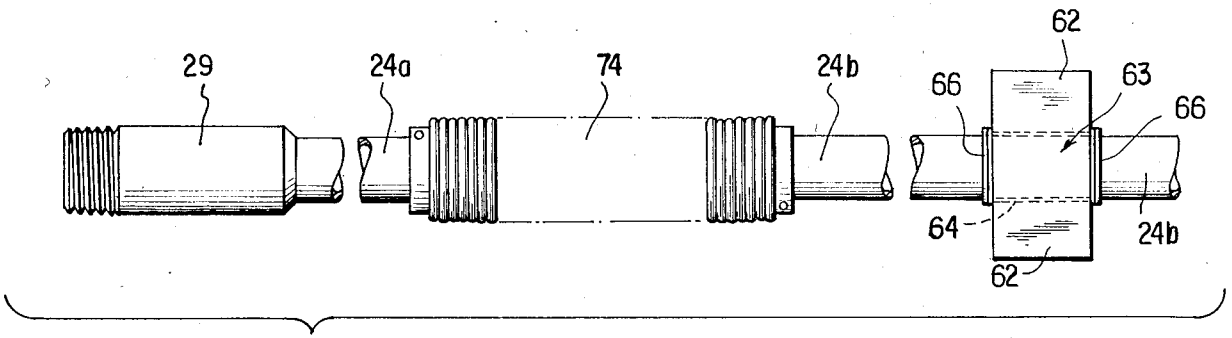
FIG. 3 is an elevational view of a portion of the system shown at FIG. 2.

Referring now also to FIGS. 3 and 4, the numeral 62 denotes any one of a plurality of radially extending legs, termed spider legs, each mounted on an apertured ethylene propylene rubber mounting element 63 which is the general form of two wedges joined at their bases and having an aperture therethrough. There are two spider legs on each mounting element 63. Legs 62 of rubber mounting elements 63 define support elements for tube 24*b*. The supports perform another important function. In the event of a siphon faiure, prior art siphons fell inside the drum 12, it was very difficult to remove the broken portion, as the journal inside diameter may be only two inches and the roll 12 inside diameter may be 36 inches. Obviously one cannot see in or reach down into with any known tool for removal. Generally a piece of weighted string is dropped in, to tangle or enmass the broken part into it, so it can be retrieved. This sometimes takes hours. With the present spider design, if a failure occurs, there can be no forward movement into the roll 12 of the broken part. The only part that could fail in the roll 12 is part 20. This would occur if snap ring 86 (later to be described) failed. Then due to the construction and material of tube 20, it would be ground up by the roll's rough surface and passed through the system, thereby eliminating the need for extraction. These elements are formed of a natural or synthetic resin, such as Teflon (polytetraflourocthylene) or other heat resistant resinous material. The numeral 64 denotes a tubular bearing having rim portions at its ends and fashioned of a selflubricating substance such as carbon graphite. The numeral 66 denotes any one of a plurality of stainless steel snap rings, the rings being positioned along straight section 24of the condensate hydraulic return line, the snap rings holding each carbon bearing 64 at a predetermined position along the line.

The numeral 70 denotes a hollow journal, here shown as extending interiorly of steam drum 12 and integral therewith. The radially outermost portions of resilient spider legs 62 are free to move axially relative to journal 70, being slidable on its interior surface.

The numeral 74 denotes a bellow expansion section, see FIG. 3, formed of 304-L stainless steel whose interior may be coated by Haylar, being a type of Teflon. Condensate return tube 24*b* is also formed of 304-L stainless steel, Schedule 10.

Figure 5:
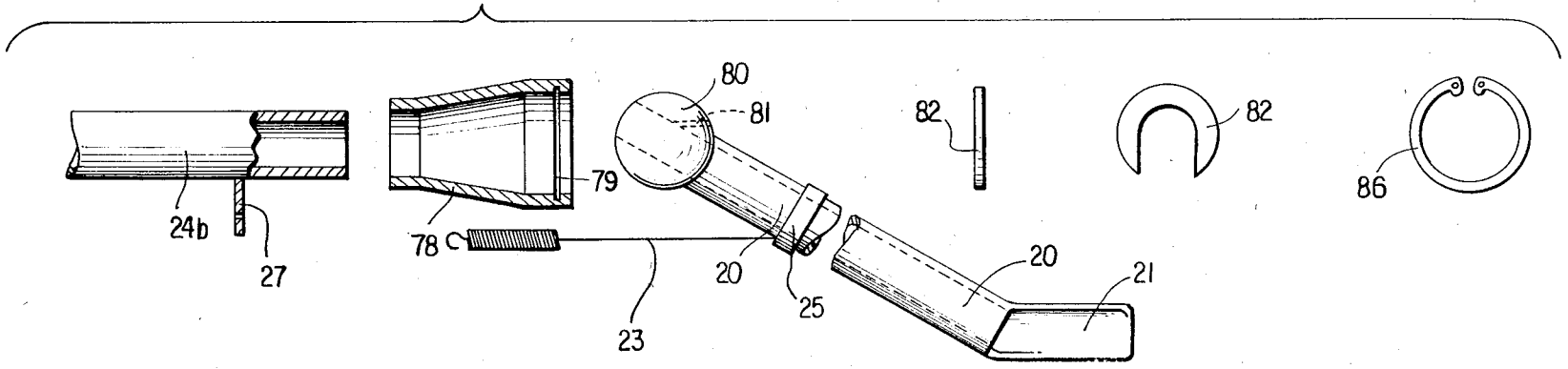
FIG. 5 is an exploded view of a joint in the drum's liquid condensate line, the view showing a washer 82 in both side elevational and plan view.

An exploded view of the joint 22 connecting tubular sections 20, 24*a*, 24*b* of the condensate return line is shown at FIG. 5. The numeral 78 denotes a junction fitting, the narrow end of which receives one end of straight tube 24*b* of the condensate return line. The wider diameter end of fitting 78 is provided with a groove 79. Numeral 80 denotes an apertured sphere formed, for example, of a hard resinous material such as Teflon, with the upper portion of tube 20, being integral with sphere 80. A vent passageway 81 of typically one-sixteenth inch diameter extends from the sphere exterior to the aperture or bore therein. Vent 81 sucks in, by an eductor or Venturi effect, any non-condensible gases in the central portion of the drum interior. Ball 80 is held in the flared portion of coupling fitting 78 by means of a washer 82 and snap ring 86, the latter fitting into groove 79 in coupling 78. The paddle or vane 21 integral with tube 20 is acted upon by the condensate 15 in such a manner that the input end of tube 20 is always immersed in the deepest portion of the condensate liquid. This action may be understood by reference to FIG. 6 wherein, with drum rotation in the indicated closewise direction, the condensate mass 15 will rise somewhat up the interior drum wall, this action insuring that paddle 21 follows the condensate mass.

The tension spring 23 biases and maintains tube 20 at its angled position relative to the (longitudinal) axis of rotation of drum 12, with vane 21 touching the drum interior.

During operation, rotation of steam dryer drum 14 about its longitudinal axis is inherently accompanied by harmonic vibration forces. Such forces are due to a variety of causes, not all of which may be eliminated. These forces are often transmitted to the hollow journal 70 and hence to spider arm and bearing supports 62 and condensate return line 20, 24*a* and 24*b* and the joint 22 which couples the angled to the horizontal portions. By forming elements 62, 64, 22, 20 and a portion of joint 22 of a non-metal, the vibration forces have a lesser destructive effect on them. Bellows 74 functions to accommodate longitudinal strains in tube 74, as may be occasioned by thermally induced as well as vibration induced forces. The bellows 74 provides another function. It allows the exterior steam union 28 to move freely in any direction. The union, known as an "S" type, causes extreme damage to siphon pipes rigidly connected to this type of steam union. The "S" is most widely used, as shown in U.S. Pat. No. 1,774,624 to Aldrich. This bellows feature is very desirable in extending the service life of a siphon and the rotaty steam union. Further, the seals in the union will also last longer. Another function enjoyed by the inclusion or use of bellows 74 is that the steam union 28 may now be removed for repair, inspection, etc. without removing the siphon. This removal feature is made possible by the provision of compression fittings, such as those of ethylene propylene, mounted in the interior ends of the bellows 74. It will also be observed that the right hand (FIG. 2) spider support element is located at the drum innermost end of hollow journal 70. From a consideration of FIG. 4, this spider support forms a flow constriction in journal 70. From known laws of fluid flow, it is seen that the drum heating steam (passing from input steam line 30 through housing 28 and journal 70 into the drum interior) will undergo an increase in velocity as it flows through this constriction, just prior to exiting from journal 70. Such increased steam velocity results in a more rapid increase of heat transfer from the latent heat of the incoming steam to the drum 12. In turn, this more rapid heat transfer, as compared to prior drying drum constructions of this type, increases web drying efficiency.

The angled tube 20, by virtue of the spherical member 80 fitting into its socket, is free to lift or slide relative to the usually uneven interior bottom wall or surface of drum 12. Normally, paddle 21 abuts this bottom wall or surface. Thus, during operation, angled tube 20 will pivot about a horizontal axis passing through sphere 80, and will accommodate or compensate for the unevenness of the drum wall to maintain the scoop 21 in contact with the drum bottom wall. This ensures that paddle or vane 21, at the radially outermost part of tube 20, is always submerged in the pool of condensate (See FIG. 6). Spring 23 normally urges paddle 21 to contact the bottom wall interior of the drum, and thus acts to bias the scoop in its desired position. A typical range of angular movement of tube 20 about a horizontal axis passing through sphere 80 is plus/minus 3 degrees, for a total angular movement of 6 degrees.

It is claimed:

1. A steam dryer drum construction including a steam supply housing, the interior of the housing adapted to receive steam from a steam generating device, a rotary steam drying drum, the drum adapted to be rotatably mounted for rotation about its longitudinal axis and whose exterior surface is adapted to contact a web of indefinite length of a material to be dried, such as a web of paper during its manufacture, a condensate tube having a horizontal portion and an angled portion, the horizontal portion having its exit end non-rotatably mounted in the steam supply housing and having its entrance end inside the steam drum, the open, input end of said angled tube portion being contiguous to the interior surface of the steam drum, a tubular journal carried by at least one end of said drying drum, and adapted to carry steam into the drum interior, at least one support spider in the tubular journal, the support spider having a plurality of radially spaced struts whose radially outermost portions slidably engage the inner walls of the hollow journal and whose central portion has an aperture through which rotatably passes the stream condensate tube, to thereby non-rotatably support the steam condensate tube, that portion of the condensate tube between its exit end and the support spider being substantially coincident with the longitudinal axis of the steam drum, whereby the steam condensate tube is supported by the spider support and does not rotate with rotation of the steam drum or the at least one support spider, the at least one support spider being positioned at the exit of the tubular journal, and wherein the regions between the radially extending arms of the at least one support spider form constructions for steam passing through the tubular journal into the steam drum interior, whereby the constrictions cause the steam to increase its velocity just prior to entry into the drum interior from the hollow journal, such increase in velocity resulting in a more rapid transfer of the latent heat energy in the steam to the drum upon entry and thermal expansion of the steam into the drum interior from the hollow journal than if the steam velocity were not increased just prior to entry of the steam from the hollow journal end into the drum interior.

2. The steam dryer drum construction of claim 1 wherein the tubular journal extends at least partially into the interior of the steam drum.

* * * * *